US005307753A

United States Patent [19]

Besonen, Sr. et al.

[11] Patent Number: 5,307,753

[45] Date of Patent: May 3, 1994

[54] WATER MOTION CUSHIONING DEVICE

[76] Inventors: Paul W. Besonen, Sr., 902 Grant St., Anoka, Minn. 55303; Jeffrey L. Besonen, 9830 Nicollet Ave. South, Bloomington, Minn. 55420

[21] Appl. No.: 685,730

[22] Filed: Apr. 16, 1991

[51] Int. Cl.[5] ..... B63B 21/00

[52] U.S. Cl. ..... 114/230; 267/73

[58] Field of Search ..... 114/215, 216, 213, 109, 114/230, 253, 293, 96; 267/69, 73, 74; 191/12 R

[56] References Cited

U.S. PATENT DOCUMENTS

| | | | |
|---|---|---|---|
| 682,536 | 9/1901 | Duncanson | 114/216 |
| 957,315 | 5/1910 | Duncanson | 114/214 |
| 2,509,357 | 5/1950 | Krause | 267/73 |
| 3,041,060 | 6/1962 | Jacobsen | 267/73 |
| 4,955,309 | 9/1990 | Ciccone | 114/230 |

*Primary Examiner*—Joseph F. Peters, Jr.
*Assistant Examiner*—Clifford T. Bartz
*Attorney, Agent, or Firm*—J. R. Cwayna

[57] ABSTRACT

A unit for cushioning and at least partially absorbing shock motions for use with marine or water equipment whereby wave and water motion is absorbed to eliminate shock wave effects. The unit includes a tension spring device extensible upon movement of the marine device for which cushioning is desired with the extension being to a limited amount and thereafter provide tight line or direct connection for uses such as retrieving an anchor or pulling in a moored boat. The unit is useable in anchoring boats and other objects in various desired positions where the desired effect is a smooth ride upon the water surface.

1 Claim, 2 Drawing Sheets

WATER MOTION CUSHIONING DEVICE

FIELD OF THE INVENTION

This invention relates generally to water and marine equipment and more particularly to a cushioning device utilized in absorbing the shock of water motions to the equipment and is directed to an extension biasing configuration as compared to a compression device.

SHORT SUMMARY OF THE INVENTION

To substantially reduce or totally absorb the affect of water motions upon anchored craft the applicant provides a telescoping tubular structure having attachment means on the respective ends thereof with an extension spring positioned intermediate each of the telescoping ends for absorbing movements. The applicants' unit may be used with an anchored article such as a boat, float or the like. The article includes an extension limiting device to positively connect to the anchoring craft only after extension of the internal spring to a predetermined length.

In this manner the unit may be placed within anchor lines to allow a sag in the anchor line and act as the absorbing element or may be utilized in marina applications for positioning a boat or the like within an anchoring area such as a slip.

The unit also includes a means for introducing water into the unit to add to the absorbing effect by providing a hydraulic absorption and cushioning action.

BACKGROUND AND OBJECTS OF THE INVENTION

Anyone that has dealt with anchoring of boats and the like is well aware of the wave effect that is generated in even relatively calm waters. It is a primary aspect of the applicants' invention to provide a unit to absorb wave effects and cushion an anchored article while, should the water be particularly rough, allowing a comfortable at-anchor ride to the occupants of the boat.

In utilizing a fishing boat in relatively rough water the occupants very often are tossed about by even relatively calm seas and with applicants' device a cushioning effect to such action is provided. With a fishing boat such water turbulence will often cause lifting of the anchor upon rising of the boat and therefore loss of fishing location. With the applicants' unit such anchor shifting is substantially eliminated.

When being used as an anchor cushioning unit, applicants' biasing element extension limiting aspect of his invention provides a means for lifting an anchor from the bottom and actually provides a dual line to the anchor. The extension limiting unit serves as a positive and direct connection to the anchor upon full extension of the biasing member.

When utilizing the device in under water situations an additional aspect of hydraulic cushioning is obtained by the entrance and exhaust of water.

In determining prior art, applicant has searched the United States Patent Office records and has found various inventions directed to water motion reducing devices. Such patents include patents to Siero, U.S. Pat. No. 4,917,039; Fiesse, U.S. Pat. No. 887,931; Duncanson, U.S. Pat. No. 682,536; Stone, U.S. Pat. No. 593,788; Bollinger, U.S. Pat. No. 3,353,817; a second patent to Duncanson, U.S. Pat. No. 957,315; Ciccone, U.S. Pat. No. 4,955,309 and Strain, U.S. Pat. No. 4,967,681.

Primarily most of these patents, with the exception of Bollinger, include compression spring devices. Obviously the utilization of a compression spring may result in the same actions and does give a positive connection to, for example, an anchor when the spring is completely compressed. Applicant's device does not include such a compression unit but rather relies on an extension biasing member and the benefits thereof are felt to be patentably distinct from compression units.

The Bollinger patent does not include a concentric type housing as provided by the applicants' unit which being concentric, allows for a piston-cylinder action accommodating water flows as a shock absorber along with the spring arrangement.

Applicants have also searched the commercially available art and have not found any devices that afford the same benefits as those in the unit of the applicants'.

It is therefore an object of the applicants' invention to provide a wave motion suppression or elimination device incorporating an extension spring therein and combining therewith a piston-cylinder cushioning effect.

It is a further object of the applicants' invention to provide a wave motion absorbing or cancellation device which includes an extension spring housed within a pair of concentrically arranged elements with an extension limiting member contained therein such that upon full extension of the extensions spring, a positive connection between a floating article and a stationary article is provided to assist in movement of either of the units.

It is a further object of the applicants' invention to provide a water exposed piston-cylinder arrangement wherein an extension spring is provided between a water containing piston and cylinder to combine a hydraulic cushioning effect with a mechanical biasing element cushioning effect to substantially reduce or cancel wave actions upon a floating article.

These and other objects and advantages of the invention will more fully appear from a considereation of the accompanying drawings and description.

SHORT DESCRIPTION OF THE DRAWINGS

DESCRIPTION OF PREFERRED FORMS OF THE INVENTION

Figure 1:
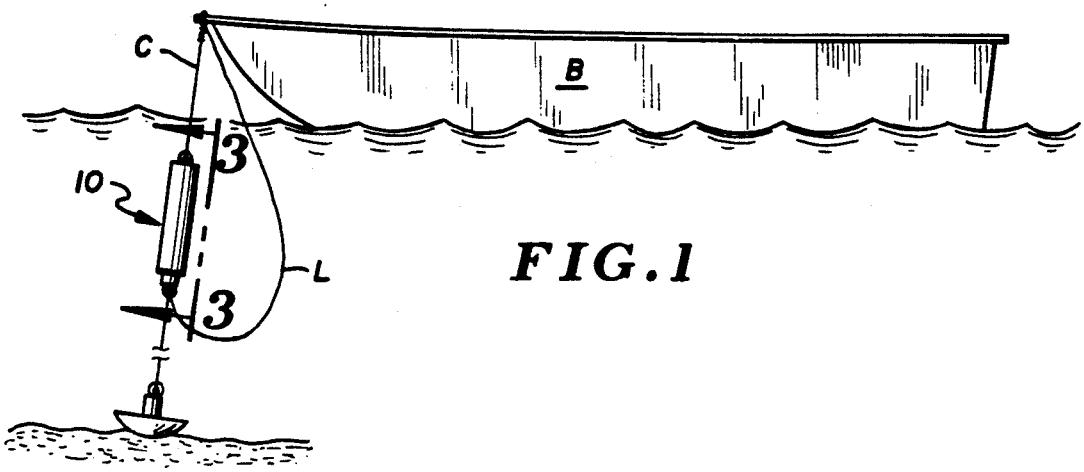
FIG. 1 is an illustration of the cushioning absorption unit embodying the concepts of the applicants' invention as the same would be utilized in anchoring a boat.
Figure 2:
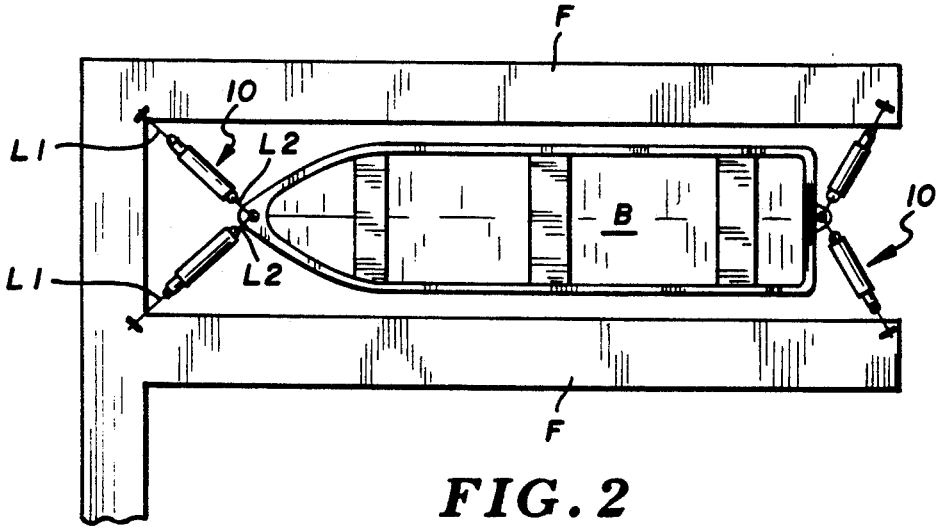
FIG. 2 is a top plan view of a typical slip installation wherein a boat or other water craft is maintained in position within the slip by using a plurality of applicants' units.
Figure 3:
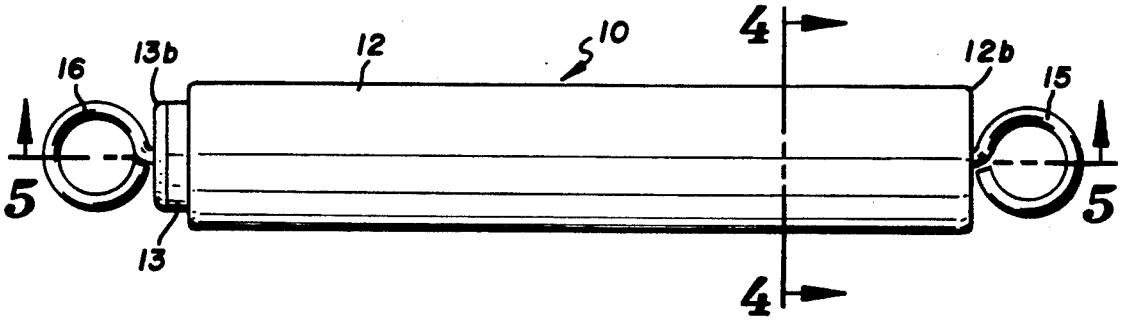
FIG. 3 is a view taken longitudinally of the unit as illustrated from the section Lines 3—3 of FIG. 1.
Figure 4:
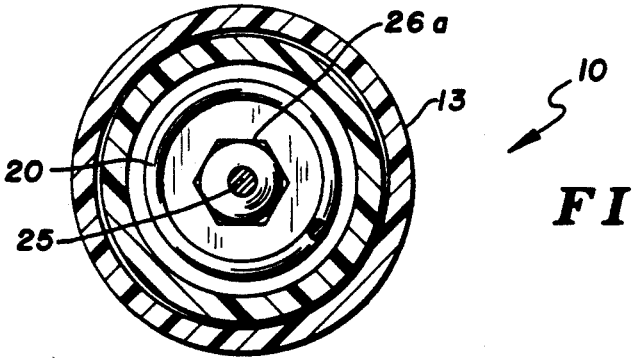
FIG. 4 is a cross section taken substantially along line 4—4 of FIG. 3.

As illustrated in the accompanying drawings the applicants' unit involving the concepts of the invention is designated generally 10 and is illustrated in two specific applications in FIGS. 1 and 2. In FIG. 1 the unit 10 is illustrated to reduce or eliminate the wave action upon a boat at anchor and it should be noted therein that the anchor rope or line L is utilized at one end of the unit 10 with the other end of the unit being directly tied to the bow of the boat through an attachment cable C which may form or may be provided with the invention upon purchase.

In the second form of use of the invention a boat is illustrated between two fingers F of a dock section. In this utilization two pairs of the unit 10 are provided and, as illustrated, the units are attached with one pair at the bow of the boat and another pair at the stern of the boat. The rearward units may also be attached to the rear corners of the craft B.

The two forms of the unit 10 illustrated herein are identical with the exception of the particular extension spring. Therefore the same numerals are utilized to designate the common parts throughout the views.

The unit includes an outer 12 and inner 13 telescoping, longitudinally extending structure wherein the tubes 12, 13 are of a size to permit the inner unit 13 to slide within the inner circumference of the larger unit 12. One end of each of the units 12*a*, 13*a* with the opposite ends being closed by plugs 12*b*, 13*b*. Note that one of such plugs 13*b* is provided with longitudinal apertures 13*c*, 13*d* to permit the flow of water into and out of the unit 10.

In the forms shown, a threaded ring element 15, 16 is provided respectively through the ends 12*b*, 13*b* of the sections 12, 13 with locking nuts 15*a*, 16*a* being provided on the shanks 15*b*, 16*b* thereof. Obviously these ring members provide a means of attachment of the unit 10 into the anchor line L with direct attachment at one end and the other end provided with a length of cable C with a quick attachment snap at the end thereof for the use illustrated in FIG. 1 or with secondary attachment lines L1, L2 for each end as illustrated in FIG. 2. In either event, the ring means 15, 16 simply provide a means of connection of the unit into the particular system.

Figure 5:
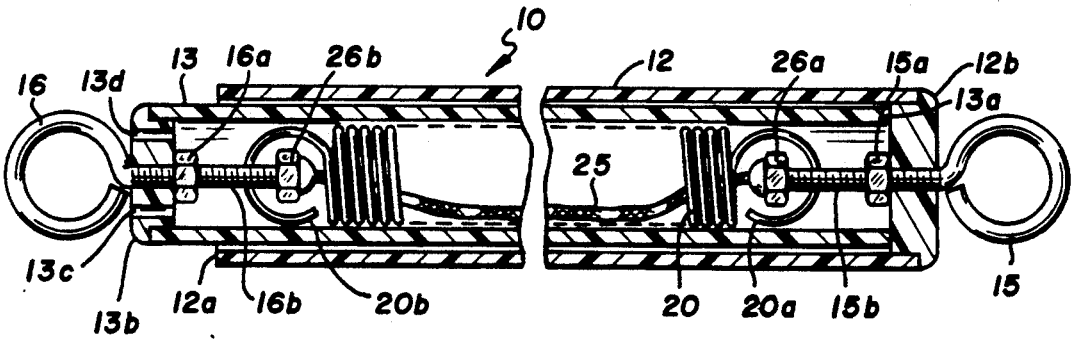
FIG. 5 is a longitudinal section taken substantially along line 5—5 and illustrating the unit in inactive form.
Figure 6:
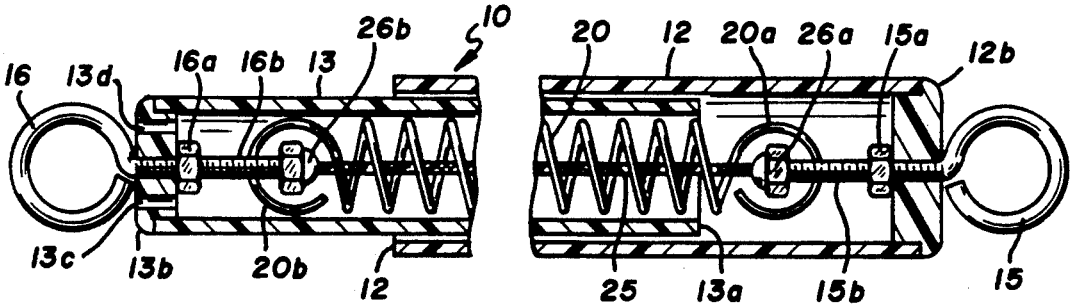
FIG. 6 is a view similar to FIG. 5 illustrating the unit of FIG. 5 in an extended position; and, FIG. 7 is a view similar to FIG. 5 illustrating a second form of the invention wherein the biasing member employed therein is of a modified form.

As illustrated in FIGS. 5 and 6, an extension spring 20 having arc shaped or circular shaped ends 20*a*, 20*b* is provided for attachment through apertures (not shown) in the respective shanks 15*b*, 16*b* of the hook elements 15, 16. Obviously this method of attachment of the spring 20 to ring elements 15, 16 is a matter of choice and the only essential aspect to consider is the fact that one end of the spring is attached to each of the respective ends of the concentric tubular structures 12, 13.

As further illustrated in FIGS. 5 and 6, a positive, connective link member such as cord 25 extends between the ends of the shank elements 15*b*, 16*b*. A simple means for capturing cord 25 is to provide a tasseling nut 26*a*, 26*b* having a passage formed through the end thereof with a knotted end of the line passing through such passage which, when the tasseling nut 26*a*, 26*b* is threaded onto the shanks 15*b*, 16*b* will effectively capture and retain the ends of the cord 25 to the ring and shank members 15, 15*b*, 16, 16*b* thus capturing the end of the cord 25 to the respective closed ends of the concentric units.

Figure 7:
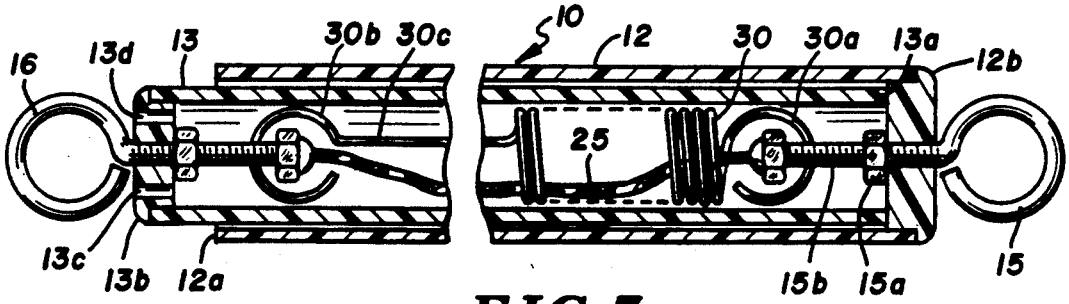

In the modified form of the invention, as stated, the identical numerals are utilized throughout the view with the exception of numeral 30 being employed for the particular extension spring and the numerals 30*a*, 30*b* being utilized for the respective ends of such extension spring. In this form of the invention the extension spring 30 is a partial spring with rod combination in that a shortened section of spring element is utilized and one end thereof 30*b* is formed through utilization of a longitudinally extending rod 30*c* integrally formed with the spring portion. The only aspect of this particular unit which varies from the first unit, as should be obvious, is the particular extension spring utilized. Obviously the extension spring utilized in the second form of the invention of FIG. 7 will substantially reduce the cost of manufacture while providing the same effective cushioning and absorption techniques for the unit.

The operation of the unit should be obvious to anyone skilled in the art. When one end of the unit 10 is anchored to an immoveable object, such as an anchor or a dock is, movement of the craft or boat B attached to the other end thereof will cause extension of the spring to thereby cushion the affect of any waves and particularly large or shock waves. One of the particular advantages of applicants' unit over the prior art is the built-in, positive connector element in the form of the connective cord 25. Although this cord is of a flexible nature as illustrated, it should be obvious that a lost motion, positive rod could be incorporated into the invention without departing from the scope of the invention. When the telescoping sections are moved longitudinally outward of each other, the cord 25 becomes a positive connector between such sections 12, 13. When the unit is extended to its full length the positive connection element 25 permits and provides a direct linkage to the attached object such as the anchor for lifting of the same from the water bottom or similarly for pulling a boat from its moored position to a boarding position closer to a dock.

It should be obvious to anyone skilled in the art this same type of "lost motion" connection between the sections 12, 13 and particularly the shank portions 15*b*, 16*b* thereof could be achieved through a tubular member having closed ends with the ends represented by nuts 26*a*, 26*b* being received therein and abutting with the ends of such tube upon extension of the unit.

When applicants' unit is utilized in an anchoring position such as that shown in FIG. 1 the water which enters therein through the respective end apertures also provides a hydraulic effect for added cushioning and shock absorption. Obviously these openings may be provided in both ends of the unit without departing from the scope of the invention.

It should be obvious that the applicants have provided a new and unique water effect cushioning and absorption element having not only the advantage of cushioning against unwanted wave action but also the advantage of providing a direct connective link to another article.

What is claimed is:

1. A water motion cushioning device including:

a. a pair of concentric, longitudinally extending, tubular members having open ends directed toward one another and closed ends, one of said members being slideable within the other such member;

b. an extensible biasing member arranged within said tubular members, said biasing member having ends;

c. said biasing member including an extension spring portion and a longitudinal rod portion said spring portion and rod portion being arranged in series, the entire length of said spring and rod portion (thereof) being substantially equal to the length of said concentric members;

d. means for attaching the ends of said biasing member to respective ends of said tubular members to allow relative, restrained, longitudinal movement therebetween;

e. attachment means on each of said tubular members closed ends for attachment of the same to locate and position a water craft; and, f. connection means between said closed ends of said tubular members preventing overextension of said biasing member and positively connecting said tubular members.

* * * * *